United States Patent [19]

Queiser et al.

[11] 4,427,893

[45] Jan. 24, 1984

[54] APPARATUS AND METHOD FOR STORING SPENT FUEL ASSEMBLIES

[75] Inventors: Horst Queiser, Maintal; Bernd Eckardt, Bruchköbel, both of Fed. Rep. of Germany

[73] Assignee: Kraftwerk Union Aktiengesellschaft, Mülheim, Fed. Rep. of Germany

[21] Appl. No.: 215,136

[22] Filed: Dec. 10, 1980

[30] Foreign Application Priority Data

Dec. 13, 1979 [DE] Fed. Rep. of Germany ..... 2950198

[51] Int. Cl.[3] ..... G21F 5/00

[52] U.S. Cl. ..... 250/506.1; 250/430

[58] Field of Search ..... 250/288, 506, 430; 376/250, 251; 73/40.7

[56] References Cited

U.S. PATENT DOCUMENTS 3,824,839 7/1974 Briggs ..... 73/40.7

3,982,134 9/1976 Housholder et al. ..... 250/506

4,197,467 4/1980 Williams ..... 250/506

4,274,007 6/1981 Baatz et al. ..... 250/506

*Primary Examiner*—Bruce G. Anderson

*Attorney, Agent, or Firm*—Herbert L. Lerner; Laurence A. Greenberg

[57] ABSTRACT

Apparatus for storing spent fuel assemblies of a nuclear reactor including a fuel-assembly transport cask having a hollow chamber for receiving therein at least one fuel assembly and having a cover for gas-tightly closing off an opening to the hollow chamber, including means for supplying a trace gas into the hollow chamber, an additional cover defining a leakage detection chamber covering the cross-section of the opening to the hollow chamber, and a measuring device for the trace gas connected to the leakage detection chamber for monitoring gas-tightness of the closure of the opening to the hollow chamber, and method for using the apparatus.

10 Claims, 1 Drawing Figure

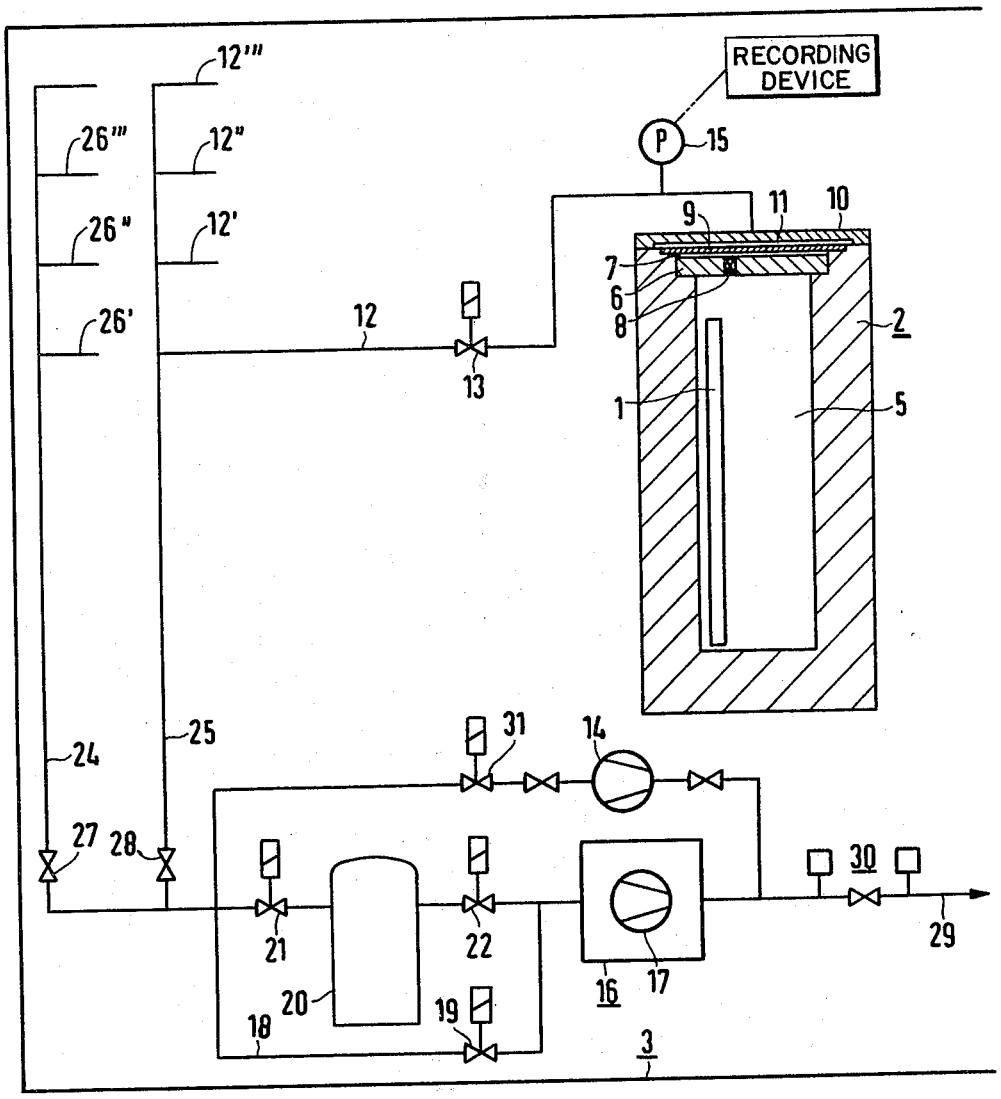
RECORDING DEVICE
P
15
12'''
12''
12'
26'''
26''
26'
12
13
9
11
10
7
6
8
2
1
5
24
25
31
14
27
28
21
22
20
18
19
16
17
30
29
3

APPARATUS AND METHOD FOR STORING SPENT FUEL ASSEMBLIES

The invention relates to apparatus as well as to a method for storing spent fuel assemblies of a nuclear reactor, employing a fuel assembly transport cask having a hollow chamber for receiving at least one fuel assembly, and having a cover for gas-tightly closing off an opening to the hollow space. In such a storage facility, it must be presupposed that the gas-tight closure remains reliably effective even for long-term storage which may, for example, last several years, because, otherwise, radioactivity might escape. Escape of radioactivity must be prevented, however, especially if the residual heat yet emanating from the spent fuel assemblies is discharged into the atmosphere through air cooling. Therefore, the invention seeks a possibility of monitoring the tightness simply yet reliably.

It is an object of the invention to provide an apparatus and method of the foregoing type which monitors the gas-tightness of the transport cask simply yet reliably.

With the foregoing and other objects in view, there is provided in accordance with the invention, an apparatus for storing spent fuel assemblies of a nuclear reactor including a fuel-assembly transport cask having a hollow chamber for receiving therein at least one fuel assembly and having a cover for gas-tightly closing off an opening to the hollow chamber, comprising means for supplying a trace gas into the hollow chamber, an additional cover defining a leakage detection chamber covering the cross-section of the opening to the hollow chamber, and a measuring device for the trace gas connected to the leakage detection chamber for monitoring gas-tightness of the closure of the opening to the hollow chamber.

Since the trace gas can reach the leakage detection chamber only through leaks, reliable detection of leaks is possible with the invention. A result therefrom is that continuous monitoring of the functioning of the sealing system for the transport cask is attained if the connection to the trace gas measuring device is always open. However, even an only temporarily, for example, periodically, existing connection permits, in a simple manner, the segregation of a leaky transport cask and/or a controlled removal of the leakage gases.

Helium is especially well suited as a trace gas because it is present in the air in such small amounts that even the smallest addtitional amounts which escape through leakage, lead to a distinct increase in the concentration thereof and can be ascertained with certainty. In principle, the invention can also be realized with other trace gases, however.

The leakage detection chamber, which preferably comprises a recess formed in the additional cover, can be connected to a measuring device for the respective transport cask. In the interest of simplification, however, several transport casks with the respective leakage detection chambers thereof are connected via valves to a common measuring device. The valves then permit the individual casks to be connected to the measuring device in such a manner that proof of tightness can be addused for each cask and a possibly leaky cask can be sorted out.

In this regard, in accordance with another feature of the invention, the means for connecting the transport casks to the common measuring device comprise lines respectively forming a grouping of all the transport casks connectible to the measuring device, which grouping is adapted to the spatial arrangement of the transport casks. The transport casks are preferably combined in rows.

In accordance with a further feature of the invention, a measuring tank having a volume which is a multiple of the volume of the leakage detection chamber is connected upstream of the measuring device in flow direction of the trace gas from the leakage detection chamber to the measuring device. The accuracy of the measurement can be improved thereby because it is possible to store the measuring gas in the measuring tank for the time of the measurement after a relatively short transport time of the measuring gas through the pipes which connect the leakage detection chamber to the measuring device, and thereby to keep away interfering leakage, for the most part, which originates from the pipeline system. In addition, the measuring tank can be brought to a high vacuum (for example, $P<10^{-1}$ mbar) due to its great leakproofness or tightness thereof, so that the pre-loading or initial loading of the measuring gas can be ignored. The influence of the gas in the pipeline can be reduced by evacuation with the vacuum pump.

In accordance with an added feature of the invention, the leakage detection chamber and the measuring device are connected to a vacuum pump to form an underpressure or negative pressure system with a pressure lower than the pressure in the hollow chamber. The measuring device, together with a vacuum pump and, if necessary or desirable, with a measuring tank, may further be formed as a mobile system which is connected via fast-acting couplers or trip couplings to the respective transport cask to be tested.

The invention also includes a method of storing spent fuel assemblies with the foregoing apparatus and comprises supplying trace gas to the transport cask, evacuating the leakage detection chamber associated with the transport cask, determining pressure increase in the leakage detection chamber, determining trace gas content in the leakage detection chamber and, if a limit value of the trace gas content of the transport cask is exceeded, selectively specially sealing, exhausting and removing the transport cask. By exhausting, there is understood to mean a controlled, optionally continuous discharge of the leakage gases.

To increase the accuracy of the leakage measurement, in accordance with another mode of the method invention, the method includes evacuating connecting lines between the leakage detection chamber and a device for determining the trace gas content of the transport cask.

The leakage gases accumulated with the invention can be stored, in principle, for ultimate storage without great expenses because of the small quantity thereof. However, in accordance with the invention they can also be discharged controllingly i.e. under controlled conditions, which means taking all radiation protection regulations and so forth into account. To remain within the permissible discharge rates, which are monitored by activity measuring stations, filters and delay sections may be employed, if necessary.

Other features which are considered as characteristic for the invention are set forth in the appended claims.

Although the invention is illustrated and described herein as embodied in an apparatus and method for storing spent fuel assemblies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a schematic view, partly diagrammatic, of the apparatus for storing spent fuel assemblies according to the invention.

Referring now to the drawing, there are provided, for interim storage of spent fuel assemblies 1 of a light-water reactor, such as a pressurized-water reactor, especially, transport, casks 2 serving as well for transporting the fuel assemblies 1 and respectively containing several, for example eight, fuel assemblies 1. The transport casks 2 are parked in rows in a storage hall indicated diagrammatically by the line 3. The hollow chamber 5 of the transport casks 2, only one of which is shown, is closed by a cover 6 provided for transport, and inserted into an opening 7 leading into the hollow chamber 5 for ensuring gastight closure. In the cover 6, a gas line accessible via a valve 8 is provided. Another cover 9 provides a flush closure at the end face of the cask 2 for transport.

After the transport cask 4 has arrived in the storage hall 3, it is evacuated, for example, to a pressure of 0.2 bar. Then, it is filled with a trace gas which is present in the ambient atmosphere only in low concentration and therefore produces an appreciable increase in the concentration beforehand by the provision of only slight additional amounts thereof. Preferably, helium is used, introduced, for example, with 10% by volume. The concentration changes thereof (He-content in air, 5 ppm) can be detected by mass spectrometry.

After the transport cask 2 is filled, a cover 10 which, together with a recess provided therein, forms a leakage detection chamber 11, is additionally placed on the upper end of the cask 2, as viewed in the FIGURE of the drawing. The cover 10 covers the entire upper end face of the transport cask 2, so that all leakage which may occur in the region of the opening 7 of the transport cask 2, is collected in the leakage detection chamber 11. The leakage detection chamber 11 is sealed as much as possible against the ambient air and limits leakage rates to a maximum of $10^{-2}$ mbar liters/sec.

The leakage detection chamber 11 is connected via a pipline 12 having a solenoid valve 13 provided therein to a vacuum pump 14. Evacuation is effected to an underpressure or negative pressure $P_2$ of about 1 mbar, which is lower than the pressure $P_1$ in the hollow chamber 5 and can be monitored by a manometer 15 if it should rise due to leakage after the valve 13 is closed.

By evacuating the leakage detection chamber 11, the initial loading on the measuring device provided for detecting the leakage is reduced and the detection sensitivity is thereby critically increased.

In the illustrated embodiment of the invention, the measuring device is a mass spectrometer 16 which, as a helium analyzer, contains a very high-vacuum pump 17, so that the gas to be analyzed can be conveyed or advanced.

The measuring device 16 is preceded by a measuring tank 20 which is isolatable by solenoid valves 21 and 33. The measuring tank 20 is shunted by a bypass line 18 with a solenoid valve 19 connected therein. In addition, the vacuum pump 14 is arranged in parallel with the serially-connected measuring device 16 and measuring tank 20. The vacuum pump 14 can be shut off via a solenoid valve 31. From the foregoing, the following procedure for monitoring the leakproofness or tightness is obtained:

Inner leakage flows into the leakage detection chamber 11 from the interior chamber 5 of the transport cask 2, and outer leakage flows into the leakage detection chamber 11 from the atmosphere. The consequent increase in mass within the leakage detecting chamber 11 leads, in the course of time, to a pressure rise in the leaking detection chamber 11. Upon reaching several times the starting pressure in the chamber 11, which is monitored continuously via the pressure measuring nanometer 15, the measuring process begins.

On the basis of the recorded pressure rise versus time, the total leakage is determined by the pressure-rise method.

Based upon the transport cask concept, there can be no preclusion that the determined total leakage is above the permissible inner leakage of the transport cask.

To differentiate between inner and outer leakage, determination of the increase in the trace gas concentration (for example, helium) by mass spectrometry is additionally necessary.

For this purpose, one of the pipeline strings, 24, 25 which are assigned to the rows of casks and each of which, respectively, has feeder lines 12, 12', 12'' and so forth and 26, 26', 26'' and so forth, respectively, is evacuated, including the measuring tank 20, to a pressure of about 1 nbar by the vacuum pump 14 and the pump 17, respectively, of the helium analyzer 16 after the respective valves 21 and 22 and 27 or 28, respectively, are opened. The vacuum pump 14 is equipped with sufficient suction capacity so that the desired limit vacuum of about 1 mbar can be attained even with a line network leakproofness or tightness of $10^{-3}$ to $10^{-2}$ mbar liters/sec.

By opening the solanoid valve 13 applied to the respective leakage detection chamber 11, the measuring gas, which is at a higher pressure level, expands in a short time through the pipeline system 12, 25 all the way into the measuring tank 20.

Through the pre-evacuation, the measuring gas initial loading or preloading by residual gas in the pipeline 12, 25 as well as in the measuring gas tank 20 is reduced and, due to the pressure-level difference, a fast inflow into the measuring gas tank is achieved. This minimizing of the inflow time permits the outer leakage penetrating into the pipeline system 12, 25 to be tolerated.

From this flow of measuring gas, a measuring gas sample is isolated in the tank 20 by closing the valves 21 and 22 which are disposed directly at the measuring gas tank 20. This tank 20 can be provided, with relatively little effort, with a leakproofness or tightness of $10^{-7}$ mbar l/sec, so that the penetrating air which falsifies the measurement, can be kept therefrom. The trace concentration increase (for example, the helium component) with respect to the air is determined by passing the measuring gas through the mass spectrometer 16.

From the concentration increase of the trace gas in the measuring gas, in combination with the total leakage rate determined by the pressure rise method, a determination may be made as to whether the permissible transport cask leakproofness or tightness exists or the permissible leakage rate has been exceeded.

In a modification of the invention, instead of the pipeline 12, a sampling facility is provided as a mobile leakage transport system at the leakage detection chamber 11. On a mobile unit, one or more measuring gas tanks as well as a vacuum pump are disposed. After being connected to the leakage detection chamber 11, the evacuated measuring gas tank serves to receive the leakage, and the vacuum pump serves for evacuating the leakage detection chamber 11. Transport to the trace gas concentration measuring device (for example, helium measurement) follows in the measuring gas tank, and transfer of the leakage gases for the purpose of measurement and controlled discharge takes place therein through evacuation. The sampling device is constructed so that the leakage gas is transferred in a short time, for example, via trip couplings and so forth and only brief access times in the radiation-exposed atmosphere of the storage hall 3 are consequently necessary.

It is also possible, however, to combine several casks 2 with separate shut-off valves 13, respectively, via a pipeline system with a common pipeline which extends to an area with less radiation exposure. At the latter location, a mobile leakage-gas transport system is connected and the transfer and, then, the evaluation and discharge of the leakage gases take place as described hereinbefore.

The pipeline system shown in the FIGURE of the drawing can also serve to discharge, under controlled conditions, increased leakage rates from leaky casks 2 by remote control during the relatively long intervals between the monitoring measurements which are also largely performed by remote control and without the use of personnel. The discharge line 29 then leads, for example, via an activity measuring station 30, to a suitable exhaust or waste gas system with non-illustrated filters, delay sections, stack and so forth.

There is claimed:

1. Apparatus for storing spent fuel assemblies of a nuclear reactor including a plurality of fuel-assembly transport casks, respectively, having a hollow chamber for receiving therein at least one fuel assembly and having a cover for gas-tightly closing off an opening in the hollow chamber, comprising means for supplying a trace gas into the hollow chamber, an additional cover defining a leakage detection chamber covering the cross-section of the opening to the hollow chamber and susceptible to receipt of leakage therein from within the hollow chamber and from the outside, and a measuring device for the trace gas connected to said leakage detection chamber for monitoring gas-tightness of the closure of the opening to the hollow chamber and for differentiating between leakage from within the hollow chamber and from the outside, means including valves for connecting the respective leakage detection chambers of the plurality of transport casks in common to said measuring device, said connecting means comprising connecting lines respectively forming a grouping of all the transport casks connectible to said measuring device, said grouping being adapted to the spatial arrangement of the transport casks.

2. Apparatus according to claim 1 including a measuring tank having a volume which is a multiple of the volume of said leakage detection chamber, said measuring tank being connected upstream of said measuring device in flow direction of the trace gas from said leakage detection chamber to said measuring device.

3. Apparatus according to claim 1 including a vacuum pump connected with said leakage detection chamber and said measuring device in a negative pressure system having a pressure lower than the pressure in the hollow chamber.

4. Apparatus according to claim 1 including a pressure measuring device connected to said leakage detection chamber.

5. Apparatus according to claim 4 including a recording device for recording pressure as a function of time, said recording device being connected to said pressure measuring device.

6. Method of storing spent fuel assemblies of a nuclear reactor including a fuel-assembly transport cask having a hollow chamber for receiving therein at least one fuel assembly and having a cover for gas-tightly closing off an opening to the hollow chamber, a measuring device connected to the cover for determining trace gas in the hollow chamber, which comprises forming a leakage detection chamber covering the cross section of the hollow chamber opening and susceptible to receipt of leakage from within the hollow chamber and from the outside, supplying trace gas to the transport cask, evacuating the leakage detection chamber associated with the transport cask, determining pressure increase in the leakage detection chamber, determining trace gas content in the leakage detection chamber for differentiating between leakage from within the hollow chamber and from the outside and, if a limit value of the trace gas content of the transport cask is exceeded, selectively specially sealing, exhausting and removing the transport cask.

7. Method according to claim 6 which comprises evacuating connecting lines connecting the leakage detection chamber and a device for determining the trace gas content of the transport cask.

8. Method according to claim 6 which comprises controllingly discharging collected leakage gases through at least one of a plurality of delay sections, filters and activity measuring stations.

9. Method according to claim 6 which comprises connecting a mobile vacuum pump, which is connected to a measuring tank, to the leakage detection chamber via a trip coupling, and connecting the measuring tank to a measuring device for the trace gas.

10. Method according to claim 9 wherein the measuring device for the trace gas is a stationary mass spectrometer, and which comprises transporting the vacuum pump with the measuring tank from the transport cask to the mass spectrometer and connecting the vacuum pump to the mass spectrometer.

* * * * *